US005569095A

United States Patent [19]

McCollum

[11] Patent Number: 5,569,095

[45] Date of Patent: Oct. 29, 1996

[54] STRAIGHT SHOT GOLF AID

[76] Inventor: Gary McCollum, 74-5491 Alapa St., Kailua-Kona, Hi. 96740

[21] Appl. No.: 555,389

[22] Filed: Nov. 9, 1995

[51] Int. Cl.[6] ..... A63B 69/36

[52] U.S. Cl. ..... 473/215; 473/277; 273/DIG. 19; 446/28

[58] Field of Search ..... 273/187.2, DIG. 19; 446/26, 28; 473/215, 216, 277

[56] References Cited

U.S. PATENT DOCUMENTS

| | | | |
|---|---|---|---|
| 3,186,124 | 6/1965 | Voss | 446/28 |
| 3,264,002 | 8/1966 | Palumbo | 273/187.2 |
| 3,368,817 | 2/1968 | Duncan | 273/187.2 |
| 3,859,886 | 1/1975 | Brisco | 273/DIG. 19 |
| 4,221,074 | 9/1980 | Gonzalez | 273/DIG. 19 |
| 4,762,325 | 8/1988 | McCleery | 273/187.2 |
| 5,085,437 | 2/1992 | Leitao | 273/187.2 |

*Primary Examiner*—George J. Marlo
*Attorney, Agent, or Firm*—Michael I. Kroll

[57] ABSTRACT

A straight shot golf aid (10) comprising a tube (26) with an elongated shaft (28) extending therefrom having a knob (32) mounted on the free end for indicating a particular direction. An assembly (14) is for suspending the indicating structure (12) in a generally horizontal manner from a front portion of a pair of pants (16), skirt, or similar garment worn by a golfer (18). When the golfer (18) is ready to make a forward movement of a golf club (20) with an intention of fairly striking at and moving a golf ball on a golf course (22), the golfer (18) can position his feet (24) by visually aiming the indicating structure (12) in the right direction the golf ball must travel.

3 Claims, 2 Drawing Sheets

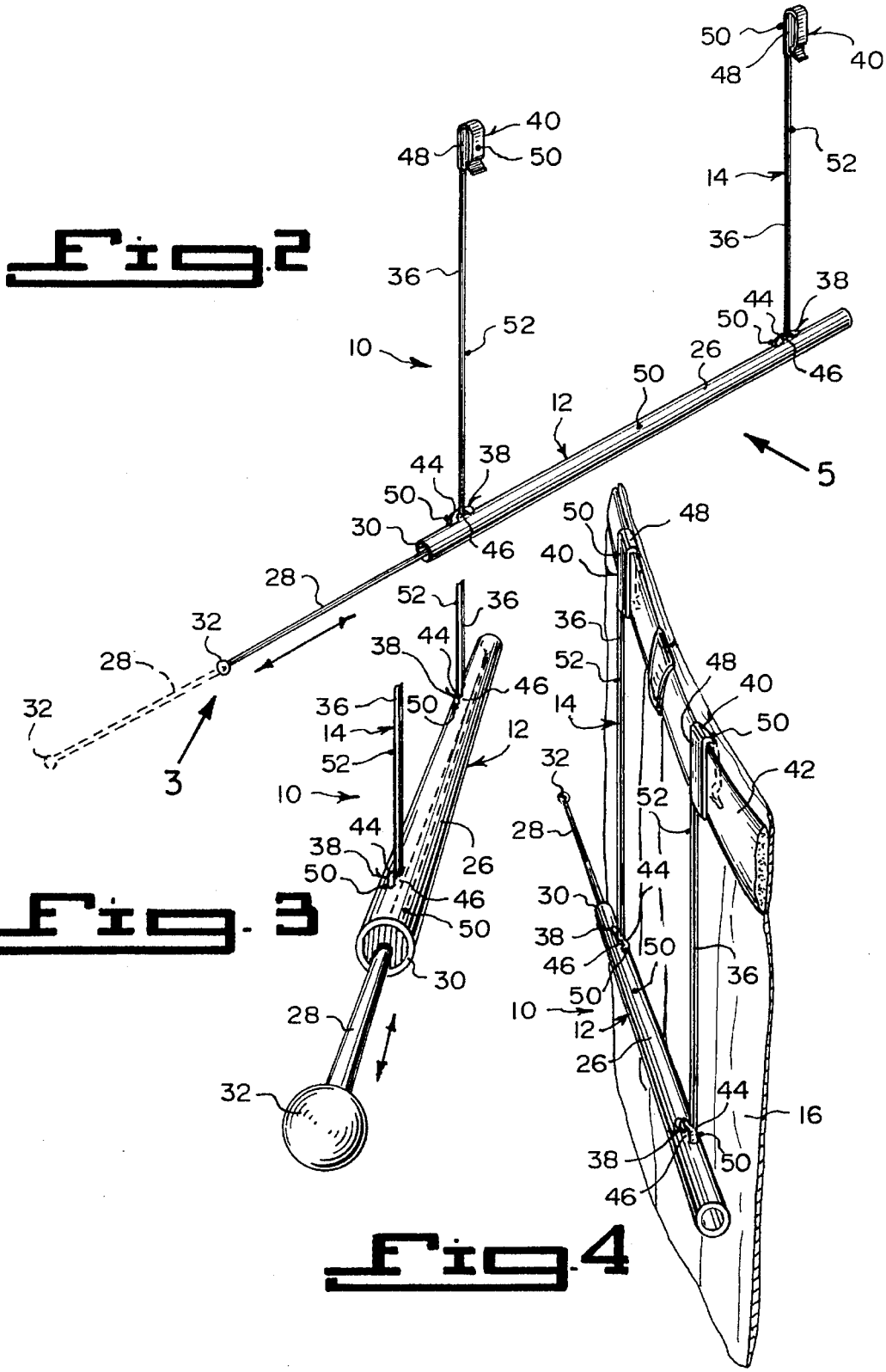
Fig. 2
Fig. 3
Fig. 4
10
12
14
16
26
28
30
32
36
38
40
42
44
46
48
50
52
3
5
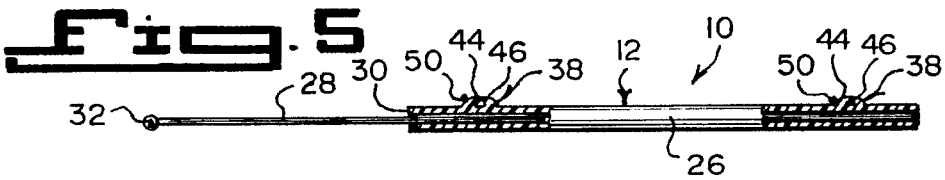
Fig. 5
10
12
26
28
30
32
38
44
46
50

STRAIGHT SHOT GOLF AID

BACKGROUND OF THE INVENTION

1. Field of the Invention

The instant invention relates generally to golf equipment and more specifically it relates to a straight shot golf aid.

2. Description of the Prior Art

Numerous golf equipment have been provided in prior art that are adapted to be any article used, worn or carried by or for a golfer, except golf clubs, golf balls and any small objects, such as coins or tees to mark the position of While these units may be suitable for the particular purpose to which they address, they would not be as suitable for the purposes of the present invention as heretofore described.

SUMMARY OF THE INVENTION

A primary object of the present invention is to provide a straight shot golf aid that will overcome the shortcomings of the prior art devices.

Another object is to provide a straight shot golf aid that helps a golfer align their stance by pointing the golfer in the right direction on the golf course, when making a stroke.

An additional object is to provide a straight shot golf aid that will reduce the amount of golf balls used during a golf game by lessening the strokes needed during the play of the golf game.

A further object is to provide a straight shot golf aid that is simple and easy to use.

A still further object is to provide a straight shot golf aid that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 2 is an enlarged perspective view of the instant invention per se, taken in the direction of arrow 2 in FIG. 1.

FIG. 3 is a further enlarged perspective view taken in the direction of arrow 3 in FIG. 2 with parts broken away.

FIG. 4 is an enlarged perspective view taken in the direction of arrow 4 in FIG. 1, with the belt and pair of pants broken away.

FIG. 5 is an elevational view taken in the direction of arrow 5 in FIG. 2, with parts broken away and in section.

Similar reference characters denote corresponding features consistently throughout the attached drawings.

DETAILED DESCRIPTION OF THE PREFERRED EMBODIMENTS

Figure 1:
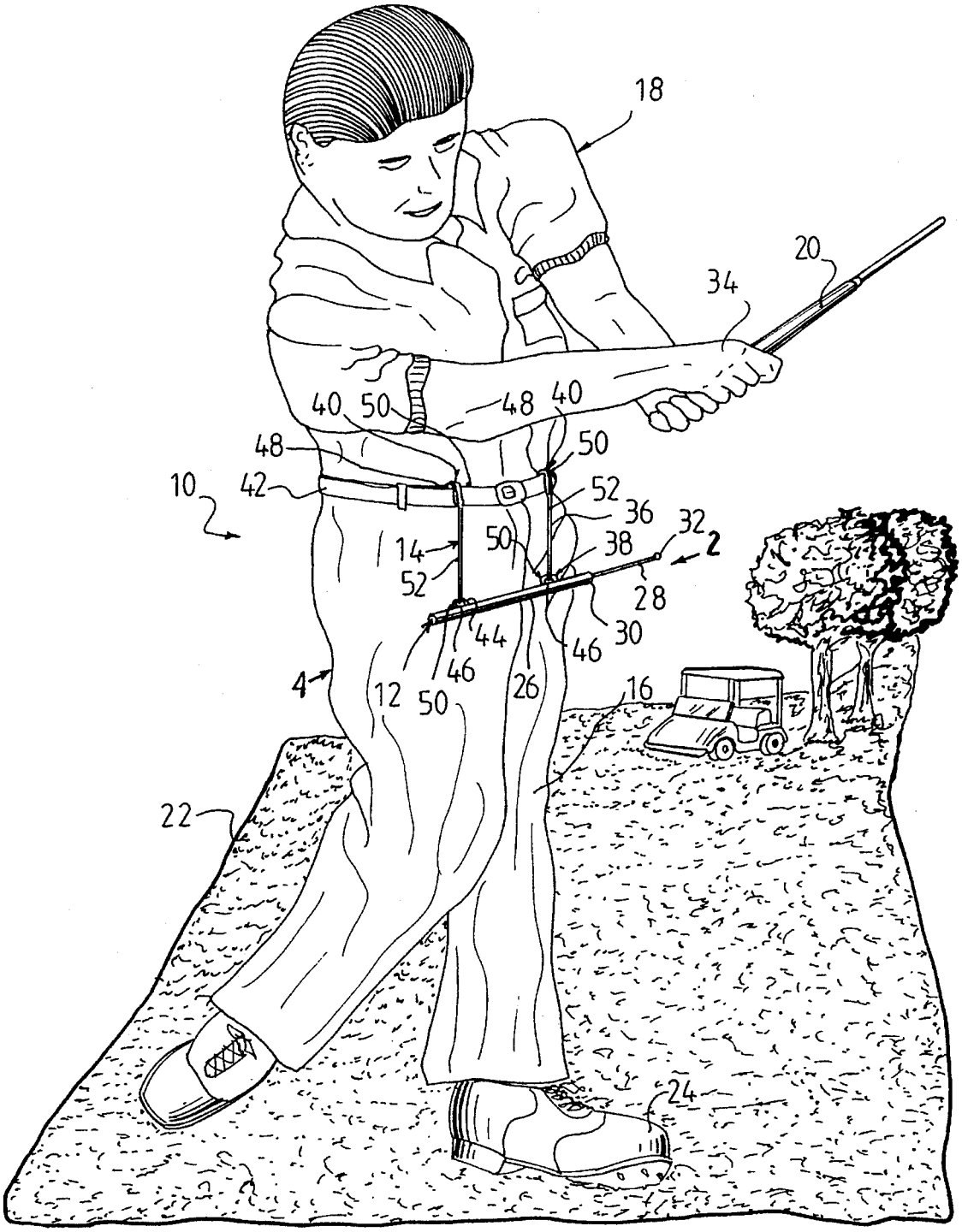
FIG. 1 is a perspective view showing a golfer on a golf course using the instant invention when making a stroke.

Turning now descriptively to the drawings, in which similar reference characters denote similar elements throughout the several views, FIGS. 1 through 5 illustrate a straight shot golf aid 10 comprising a structure 12 for indicating a particular direction. An assembly 14 is for suspending the indicating structure 12 in a generally horizontal manner from a front portion of a pair of pants 16 worn by a golfer 18. When the golfer 18 is ready to make a forward movement of a golf club 20, with an intention of fairly striking at and moving a golf ball on a golf course 22, the golfer 18 can position his feet 24 by visually aiming the indicating structure 12 in the right direction the golf ball must travel.

The indicating structure 12 is an elongated tube 26. An elongated shaft 28 slides within the elongated tube 26, so that a portion of the elongated shaft 28 can extend outwardly from one side 30 of the elongated tube 26 to function as a pointer.

A knob 32 is affixed to a free end of the elongated shaft 28 extending from the elongated tube 26. The knob 32 can be grasped by a hand 34 of the golfer 18 and pulled to further extend the elongated shaft 28 from the elongated tube 26 to enhance the elongated shaft 28 as the pointer. The knob 32 can be pushed to retract the elongated shaft 28 back into the elongated tube for storage when not in use.

The suspending assembly 14 consists of a pair of straps 36 being of equal lengths. Components 38 are for connecting a first end of each strap 36 to the indicating structure 12. An element 40 on a second end of each strap 36 is for engaging with a front portion of a belt 42 that is on the pair of pants 16, skirt (not shown), or similar garment worn by the golfer 18.

The connecting components 38 are a pair of spaced apart lugs 44 affixed to the indicating structure 12 in an aligned manner. Each lug 44 has an aperture 46 therethrough, so that the first end of each strap 36 can be connected to each lug 44 through the respective aperture 46.

The engaging elements 40 are a pair of hooks 48. Each hook 48 is connected to the second end of each strap 36. The hooks 48 can engage with the front portion of the belt 42 on the pair of pants 16, skirt (not shown), or similar garment worn by the golfer 18.

The indicating structure 12 is completely fabricated out of a strong durable material 50. The strong durable material is plastic. Each strap 36 is a narrow strip of flexible material 52. Each lug 44 and hook 48 is also fabricated out of the strong durable material 50, which is plastic.

OPERATION OF THE INVENTION

To use the straight shot golf aid 10 the following steps should be taken:

1. Snap the hooks 48 onto the front portion of the belt 42 on the pair of pants 16 worn by the golfer.

2. Let the straps 36 hang down so that the elongated tube 26 is in a generally horizontal manner.

3. If the golfer 18 is right handed, make sure that the knob 32 is on the left side of the golfer 18.

4. If the golfer 18 is left handed, make sure the knob 32 is on the right side of the golfer 18.

5. Pull the knob 32 to extend the elongated shaft 28 from the side 30 of the elongated tube 26, so that it will point to the left.

6. The golfer 18 can position his feet 24 on the golf course 22 and aim the elongated shaft 28 in the proper direction, to stroke the golf ball with the golf club 20.

LIST OF REFERENCE NUMBERS

10 straight shot golf aid
12 indicating structure of 10
14 suspending assembly of 10
16 pair of pants on 18
18 golfer
20 golf club
22 golf course
24 feet of 18
26 elongated tube of 12
28 elongated shaft of 12
30 one side of 26
32 knob on 28
34 hand of 18
36 strap of 14
38 connecting component of 14
40 engaging element of 14
42 belt
44 lug for 38
46 aperture in 44
48 hook for 40
50 strong durable material (plastic) for 12, 44 and 48
52 narrow strip of flexible material for 36

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A straight shot golf aid for assisting a golfer wearing a waist belt to position his or her feet while executing a golf club swing comprising:

a) a waist belt including means for indicating a particular direction comprising an elongated straight tube having an open end at one end thereof, an elongated shaft slidably mounted within said tube with one end of said elongated shaft extending out the open end of said tube and a knob mounted on said one end of said shaft, said tube and shaft functioning as a pointer with said knob pointing in the direction where a golf ball is to be directed, said shaft being retracted into said tube when not in the pointing position; and b) means for suspending said indicating means in a generally horizontal manner from said waist belt when in use comprising a pair of spaced apart lugs affixed to said tube in an aligned manner, each of said lugs having an aperture therethrough, a pair of straps of equal length, one end of each strap being attached to a lug on said tube, the other end of each said strap having means to engage said waist belt to position said tube in a horizontal position, said golfer positioning his or her feet so that said tube with the shaft and knob point in the direction said golf ball is to be hit by the golfer.

2. A straight shot golf aid as recited in claim 1, wherein said engaging means includes a pair of hooks, whereby each said hook is connected to the second end of each said strap, so that said hooks can engage with the front portion of said belt.

3. A straight shot golf aid as recited in claim 1, wherein each said strap is a narrow strip of flexible material.

* * * * *